US007063221B2

(12) United States Patent
Garcia-Cuenca et al.

(10) Patent No.: US 7,063,221 B2
(45) Date of Patent: Jun. 20, 2006

(54) METHOD FOR MAKING A STOPPER FOR SPARKLING WINE BOTTLES

(75) Inventors: Enrique Garcia-Cuenca, Biarritz (FR); Jacques Pitoux, Heric (FR); Michel Pitoux, Manciet (FR)

(73) Assignee: Au Lieguer-ETS J. Pontneau Denis, Soustons (FR)

( * ) Notice: Subject to any disclaimer, the term of this patent is extended or adjusted under 35 U.S.C. 154(b) by 3 days.

(21) Appl. No.: 10/203,489

(22) PCT Filed: Feb. 9, 2001

(86) PCT No.: PCT/FR01/00382

§ 371 (c)(1),
(2), (4) Date: Aug. 9, 2002

(87) PCT Pub. No.: WO01/58777

PCT Pub. Date: Aug. 16, 2001

(65) Prior Publication Data

US 2003/0019830 A1 Jan. 30, 2003

(30) Foreign Application Priority Data

Feb. 10, 2000 (FR) ..... 00 01642

(51) Int. Cl.
*B65B 7/28* (2006.01)
*B65D 39/00* (2006.01)
*B65D 51/16* (2006.01)

(52) U.S. Cl. ..... 215/355; 53/488; 53/489; 215/43; 215/46; 215/307; 220/787; 220/788; 220/801

(58) Field of Classification Search ..... 215/40, 215/307, 362, 355, 43, 46; 53/489, 471, 53/487, 488; 220/787, 788, 801
See application file for complete search history.

(56) References Cited

U.S. PATENT DOCUMENTS 767,947 A * 8/1904 Koch ..... 215/302
1,419,747 A * 6/1922 Miller ..... 215/40
1,819,279 A * 8/1931 Coyle ..... 220/366.1
2,370,535 A 2/1945 Harrison (Continued)

FOREIGN PATENT DOCUMENTS

EP 0027780 4/1981

(Continued)

*Primary Examiner*—Nathan J. Newhouse
*Assistant Examiner*—Niki M. Eloshway
(74) *Attorney, Agent, or Firm*—James Ray & Assoc.

(57) ABSTRACT

The invention provides a method of making a stopper (2) of cork of natural and/or synthetic origin for a bottle of sparkling wine of the Champagne type, said stopper (2) having a base suitable for constituting a fraction of the inside wall (17) of said bottle (6) and an outside wall (30) suitable for bearing against the inside wall (24) of the neck (4). The method consists: in acting during closure of said bottle (6) to deform said outside wall (30) of said stopper (2) longitudinally over at least a portion extending to its base, so as to provide at least one channel-forming groove (18, 33) in said stopper; and in maintaining the longitudinal deformation throughout the period said bottle (6) is closed by said stopper (2) so that said channel-forming groove (18, 33) persists when said bottle is partially opened.

23 Claims, 1 Drawing Sheet

U.S. PATENT DOCUMENTS 2,848,130 A * 8/1958 Jesnig ..... 215/45
4,192,429 A * 3/1980 Yerman ..... 215/307
4,401,226 A * 8/1983 Brown ..... 215/250
5,046,627 A * 9/1991 Hansen ..... 215/40
5,325,977 A * 7/1994 Haynes et al. ..... 215/307
5,702,018 A * 12/1997 Montgomery ..... 220/203.13
5,803,285 A * 9/1998 Hirota ..... 215/296
5,897,008 A * 4/1999 Hansen ..... 215/48
6,491,176 B1 * 12/2002 Schollenberger et al. ... 215/307

FOREIGN PATENT DOCUMENTS

FR 1121397 8/1956
FR 1091050 4/1995

* cited by examiner

METHOD FOR MAKING A STOPPER FOR SPARKLING WINE BOTTLES

The present invention relates to a method of making a stopper of cork of natural and/or synthetic origin for stopping sparkling wine bottles, particularly but not exclusively for stopping Champagne bottles.

The present invention also provides apparatus for making such a stopper.

Sparkling wine bottles are generally closed by means of a stopper made of cork or of plastics material, which stopper is held in the neck of the bottle by a metal device or "wiring" which holds the stopped fraction of the stopper to the end of the neck.

It is necessary for the stopper to be held in order to prevent it from being ejected in untimely manner, since a large force is exerted on the stopper, given that the pressure inside such bottles is a few atmospheres.

When a bottle is opened, the wiring, which is essentially made up of metal wires, is removed by the operator who then opens the bottle, ideally by taking hold of the end of the stopper and twisting it back and forth relative to the neck.

Nevertheless, the pressure inside the bottle is such that the cork can be violently ejected as soon as the wiring is removed without leaving the operator any time to take hold of the end of the stopper, and this represents a risk both to the operator and to people nearby, in particular concerning the face and more specifically the eyes.

An object of the invention is to propose a method of making a stopper of cork of natural and/or synthetic origin comprising a base suitable for constituting a fraction of the inside wall of said bottle and an outside wall suitable for bearing against the inside wall of the neck, with untimely violent ejection of the stopper being made impossible.

To achieve this object, the method of the invention comprises the following steps: during closure of said bottle, longitudinally deforming said outside wall of said stopper at least in a portion extending to its base, so as to form at least one channel-forming groove in said stopper, a first end of said channel opening out into a portion of said inside wall fraction and a second end of said channel opening out into said outside wall of said stopper; and maintaining the longitudinal deformation throughout the time said bottle is closed by said stopper so that said channel-forming groove persists when said bottle is partially opened, so that said second end of said channel opens to the outside of said bottle and puts the inside of the bottle into communication with the outside.

Thus, a characteristic of the invention resides in the way in which the deformation of the outside wall of the stopper extends longitudinally to its base during closure of said bottle and the way said deformation is maintained throughout the period during which the neck of the bottle is closed by said stopper, thereby leading to a persistent groove being formed which constitutes a channel that remains while the stopper is being removed from the neck. As a result, once the stopper has been disengaged from the neck of the bottle sufficiently for the second end of said channel which opens out into a portion of the outside wall to be situated outside the bottle and to be in communication with the first end of the channel which opens out into a portion of the inside wall fraction, the inside of the bottle communicates with the outside and the gas contained inside tends to escape.

In a particular implementation of the invention, during closure of said bottle, said outside wall of said stopper is deformed substantially vertically over a portion extending to its base, so as to form at least one channel-forming vertical groove in said stopper. As a result, the stopper can be extracted vertically from the neck of the bottle.

In particular advantageous manner, during closure of said bottle, said outside wall of said stopper is deformed longitudinally over at least a portion extending to its base, by progressively deforming said wall towards said base whereby disengaging said stopper from the neck parallel to said deformation partially releases said channel-forming groove. Thus, the channel-forming groove is oblique relative to the inside wall of the neck of the bottle and makes it easier to release the gas present inside the bottle, as explained in greater detail below.

Advantageously, during closure of said bottle, said outside wall of said stopper is deformed longitudinally over at least a portion extending to its base, to provide deformation that is in the form of half a cone. Thus, not only is said deformation easier to implement, but also the ejection of gas during removal of the stopper from the neck is facilitated.

Preferably, during closure of said bottle, said outside wall of said stopper is deformed longitudinally over at least a portion extending to its base, over a length lying in the range 10 millimeters (mm) to 20 mm.

The present invention also provides apparatus for making a stopper of cork of natural and/or synthetic origin for a sparkling wine bottle, the apparatus comprising means for acting during closure of said bottle to deform said outside wall of said stopper longitudinally over at least a portion extending to its base and to maintain said outside wall deformed throughout the period said bottle is closed by said stopper so as to make at least one channel-forming groove in said stopper, a first end of said channel opening out into a portion of said inside wall fraction and a second end of said channel opening out into said outside wall of said stopper.

Thus, the apparatus of the invention serves both to deform and to keep deformed at least a portion of said outside wall of said stopper extending from its base so that said channel-forming deformation persists while the stopper is being removed and enables communication to be established between the inside and the outside of the bottle.

In a particular embodiment, the apparatus comprises: a bottle terminated by a neck; and at least one rib secured to said inside wall of said neck, the rib being disposed substantially vertically and extending as far as said inside wall of the bottle. Thus, when the bottle is closed and the stopper is forced into the neck, the rib which projects from the inside wall of the neck forms a longitudinal groove in a portion of the outside wall of the stopper, said groove opening out into the base of the stopper which constitutes a fraction of the inside wall of the bottle. So long as the stopper remains engaged in the neck, the rib closes the groove that it has created in the outside wall of the stopper and the closure remains leaktight.

In a particularly advantageous embodiment of the invention, the means for deforming said outside wall of said stopper longitudinally over at least a portion and for maintaining the deformation comprise a rib of section that increases going from the neck towards the inside wall of the bottle. As a result, as soon as the stopper is at least partially disengaged from the neck of the bottle, it will be understood that the oblique rib is partially disengaged from the likewise oblique groove that it was previously closed, thereby allowing the gas contained inside the bottle to pass between the rib and the groove. When the second end of the channel comes flush with the top end of the bottle neck, the gas contained inside the bottle escapes via said channel.

Preferably, said rib is in the shape of half a cone, thus making it easier to form the rib in the neck and also easier to force the stopper into place.

In a particular embodiment of the invention, said rib extends over a length lying in the range 10 mm to 20 mm so as to form a groove that is more than 10 mm long. Thus, when the groove presents a minimum length of 10 mm, the gas inside the bottle begins to escape as soon as the length of the stopper which remains engaged in the neck becomes less than 10 mm.

In another particular embodiment, said rib forms an integral fraction of a ferrule which is applied against the inside wall of the neck in the top end of said neck. The rib is thus no longer fixed to the inside wall of the neck, but is pressed against said wall and held by a ferrule. As a result, while the stopper is being disengaged from the neck and the ferrule remains secured to said neck, gas exhaust from the bottle can take place in the same manner as in the preceding embodiments.

In a third aspect, the present invention also provides a container for sparkling wine under pressure including apparatus for making a stopper of cork of natural and/or synthetic origin. Said apparatus comprises means for acting during closure of said bottle to deform said outside wall of said stopper longitudinally over at least a portion extending to its base and to maintain said outside wall deformed throughout the period said bottle is closed by said stopper so as to form at least one channel-forming groove in said stopper, a first end of said channel opening out into a portion of said inside wall fraction and a second end of said channel opening out into said outside wall of said stopper. Said container further comprises a stopper of cork of natural and/or synthetic origin closing the neck of said bottle.

Other features and advantages of the invention appear on reading the following description of particular embodiments of the invention given by way of non-limiting indication and with reference to the accompanying drawing, in which.

Figure 1:
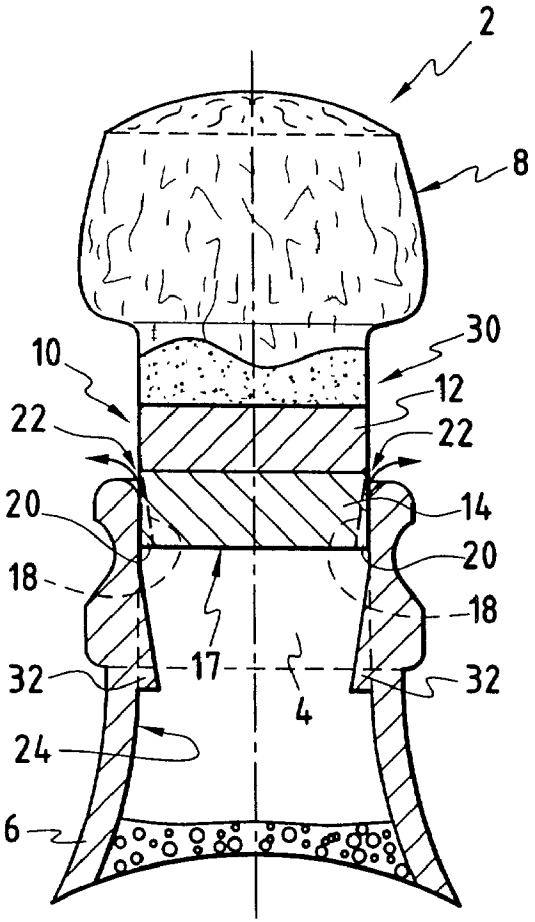
FIG. 1 is a fragmentary vertical section through apparatus for making a stopper of the invention, and through the stopper made in this way.

With reference initially to FIG. 1 there follows a description of apparatus for implementing the method of making a stopper in accordance with the invention.

The apparatus for making a stopper 2 of cork of natural and/or synthetic origin comprises: a bottle 6 terminated by a neck 4.

In FIG. 1, the stopper 2 is shown partially engaged in the neck 4 of the bottle 6. The cork stopper 2 has a top end 8, and a bottom end 10 suitable for being inserted in said neck 4.

The top end 8 of the stopper 2 is generally made of agglomerated cork particles, whereas the bottom end 10 as shown in FIG. 1 comprises two superposed cork disks 12 and 14 that are stuck together, said disks being directly extracted from sheets of raw cork. The last disk 14 which forms the base of the stopper has a wall 17 which constitutes a fraction of the inside wall of the bottle 6 coming directly into contact with the content thereof.

One of the advantages provided by the method of making the stopper 2 of the invention is that it makes it possible to use a standard stopper for stopping sparkling wines, and it is by means of the bottle 6 that the stopper 2 is formed during stopping.

For this purpose, the apparatus for making the stopper 2 comprises two ribs 32 secured to said inside wall 24 of said neck 4, being disposed substantially vertically and extending as far as said inside wall of the bottle 6.

In addition, in particularly advantageous manner, the top ends of the ribs are set back from the top edge of the neck 4 by a distance of more than 5 mm. This minimum distance is necessary during opening of the bottle, as explained in greater detail below.

In the standard case, the grooves extend over a length lying in the range 10 mm to 20 mm, e.g. 15 mm, with the width and depth of the grooves lying in the range 1 mm to 5 mm, e.g. 3 mm. These dimensions are not limiting in any way and they depend on the respective sizes of the bottle and the stopper.

In accordance with the method of the invention for making a stopper, when the bottle is full of liquid to be isolated from the outside or when additional ingredients are put into a bottle that has already been filled and capped, the stopper which is initially cylindrical in shape is forced into the neck 4 so that the bottom end 10 of the stopper 2 covers the ribs 32, at least in part.

Thus, the rib 32 deforms the outside wall of the stopper 30 producing two vertical grooves 18 in said surface once the stopper 2 has been pushed in. The groove 18 is imprinted in the stopper 2 for as long as it continues to close the neck 4 of the bottle 6. The length of time the bottle 6 is stored is sufficient for the imprinting of the rib 32 in the stopper 2 to become definitive. This imprinting thus forms the groove 18 which acts during opening as a channel.

The two vertical grooves 18 are formed in the outside wall constituting the periphery of the stopper 2, and more precisely in the bottom end thereof.

When the bottom end 10 of the stopper 2 is fully engaged in the neck 4, the grooves 18 constitute two channels having first ends 20 that open out in the wall 17 adjacent to the inside wall 24 of the neck 4 and second ends 22 which are closed by the inside wall 24 of the neck 4.

In this configuration, the stopper 2 closes the bottle 6 in leaktight manner since the channels are closed by the inside wall 24 of the neck 4 and the ribs 32 are received in the grooves 18 that they have formed.

When the stopper 2 is partially disengaged from the neck 4, as shown in FIG. 1, so that the ends 22 of the grooves 18 are in the open air, the inside of the bottle 6 is in communication with the outside and gas under pressure contained inside the bottle 6 is released.

Once the gas has been released, there is no longer any force acting on the stopper 2 to cause it to be ejected from the neck 4 and the neck is released by manually extracting the stopper 2.

In the above description, two grooves 18 are formed in the stopper by means of two ribs 32, but naturally additional grooves would be formed if there are additional ribs and a single groove could be implemented by using a single rib.

Figure 3:
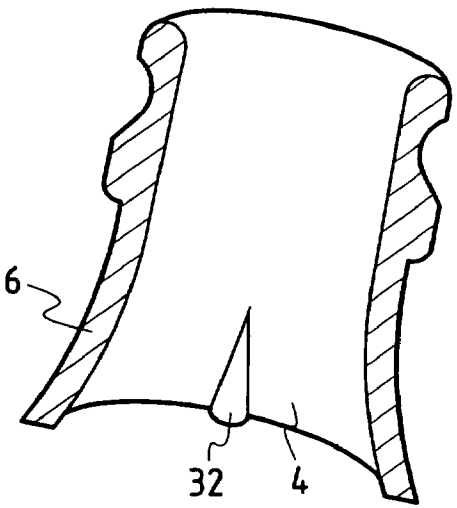
FIG. 3 is a vertical section view of apparatus for making a stopper of the invention.
Figure 2:
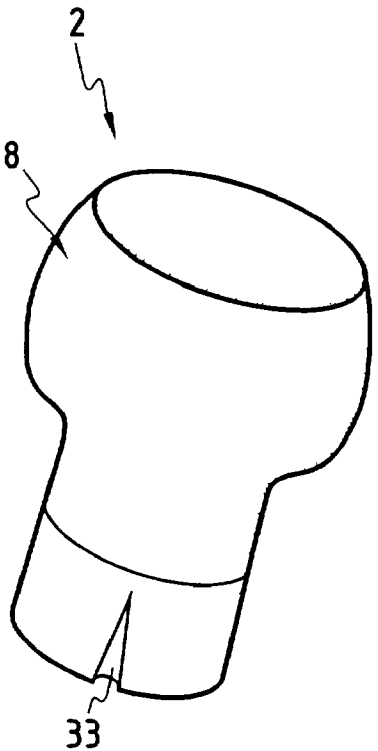
FIG. 2 is a perspective view of a stopper obtained by the method of the invention.

Advantageously, as shown in FIGS. 1, 2, and 3, the ribs 32 are in the form of half-cones extending over a length lying in the range 10 mm to 20 mm, with the base of the cone presenting a diameter lying in the range 2 mm to 5 mm and with the tip of the cone being directed towards the top end of the bottle 6. Thus, moving the stopper 2 vertically inside the neck 4 towards the top end of said neck 4 releases at least a fraction of the channel that the rib 32 has formed over the entire length of that channel, thereby allowing gas to escape, providing the top end of the channel is in the open air.

It will be understood that the tapering ribs 32 imprint complementary grooves 18 that are likewise tapering. Thus, as soon as the grooves 18 have been moved longitudinally relative to said ribs 32, an empty space appears between each rib and its groove. It is through this space that gas can escape from the bottle.

As a result, it will be understood that if the ribs were flush with the edge of the neck, then the grooves would also be flush therewith and the slightest displacement of the stopper would put the inside and the outside of the bottle into communication and allow gas to escape. However, thrust from the gas is necessary in order to extract the stopper from the neck, at least to some extent, since the stopper is held securely therein.

Thus, the distance between the top ends of the grooves and the edge of the neck is sufficient to avoid this snag.

In addition, the ribs should be positioned in such a manner that the deformation imprinted in the outside wall of the stopper 2 extends to the wall 17 of the disk 16 so that the groove 18 opens out into said wall 17.

If the ribs 32 were to be completely covered by the bottom end 10 of the stopper 2, then: firstly the groove imprinted by the rib would not open out into the wall 17 of the disk 16 and consequently whatever the position of the stopper 2 in the neck 4 no escape of gas would be possible; and secondly the bottom end of the rib would constitute an abutment suitable for impeding extraction of the stopper 2.

In a particular embodiment, the rib 32 is not generally conical in shape but is of constant width, with the channel being released by said rib 32 so as to allow gas to escape only once the stopper 2 has completely disengaged the portion of the inside wall 24 of the neck 4 from which the rib 32 projects.

In another particular embodiment, the ribs 32 are molded during manufacture of the bottle so as to be integral with the neck 4 of the bottle 6.

Advantageously, the ribs are integral with a ferrule which is pressed against the inside wall 24 of the neck 4, in the top end of said neck. The ferrule is made of molded plastics material and presents rims for fixing to the outside wall of the top end of the neck 4.

To close the bottle, the ferrule is initially put into place in the top fraction of the neck 4, and then the stopper is thrust into the neck in conventional manner.

The invention claimed is:

1. A bottle for sparkling wine of the Champagne type, terminated by a neck for receiving a stopper comprising a top end and a bottom end, said bottom end having a base suitable for constituting a fraction of an inside wall of said bottle and an outside wall suitable for bearing against an inside wall of said neck of said bottle, wherein the bottle comprises elongated means provided on said inside wall of said neck and extending along a longitudinal axis of said bottle for a distance of more than 5 mm from an end of said neck of said bottle as far as the inside wall of said bottle, said elongated means being tapered only in a direction toward said top end of said neck, for deforming said outside wall of said stopper longitudinally over at least a portion extending from said base of said stopper and for continuing deformation of said outside wall throughout a period said bottle is closed by said stopper so as to make at least one rectilinear channel-forming groove in said stopper, a first end of said channel-forming groove opening out into a portion of said inside wall fraction and a second end of said channel opening out into said outside wall of said stopper, said means thereby enabling an escape of gas contained in said bottle via said first and second ends of said channel-forming groove when said stopper is disengaged from a bottom portion of said neck.

2. A bottle according to claim 1, comprising:

at least one elongated rib secured to said inside wall of said neck and spaced from the top end of said neck, said elongated rib being disposed vertically and extending along a longitudinal axis of the bottle as far as said inside wall of the bottle.

3. A bottle according to claim 2, wherein the elongated means for deforming said outside wall of said stopper longitudinally over at least a portion and for maintaining the deformation comprise an elongated rib having a cross-section that increases along a direction going from the end of the neck towards the inside wall of the bottle.

4. A bottle according to claim 3, wherein said elongated rib is in the shape of half a cone.

5. A bottle according to claim 4, wherein said elongated rib extends over a length lying in the range 10 mm to 20 mm.

6. A bottle according to claim 5, wherein said elongated rib is integral with a ferrule which is applied against the inside wall of the neck in the top end of said neck.

7. A bottle according to claim 4, wherein said elongated rib is integral with a ferrule which is applied against the inside wall of the neck in the top end of said neck.

8. A bottle according to claim 3, wherein said elongated rib extends over a length lying in the range 10 mm to 20 mm.

9. A bottle according to claim 3, wherein said elongated rib is integral with a ferrule which is applied against the inside wall of the neck in the top end of said neck.

10. A bottle according to claim 2, wherein said elongated rib extends along said longitudinal axis of said bottle over a length lying in the range 10 mm to 20 mm.

11. A bottle according to claim 10, wherein said elongated rib is integral with a ferrule which is applied against the inside wall of the neck in the top end of said neck.

12. A bottle according to claim 2, wherein said elongated rib is integral with a ferrule which is applied against the inside wall of the neck in the top end of said neck.

13. A bottle according to claim 1, the neck of said bottle being closed by a stopper of cork of natural and/or synthetic origin.

14. A bottle according to claim 13, wherein said elongated rib is integral with a ferrule which is applied against the inside wall of the neck in the top end of said neck.

15. A method of deforming a stopper of cork of one of natural, natural and synthetic, and synthetic origin for a bottle for sparkling wine of the Champagne type, said stopper comprising a top end and a bottom end suitable to be introduced into the neck of a bottle, said bottom end having a base suitable for constituting a fraction of the inside wall of said bottle, and an outside wall suitable for bearing against an inside wall of a neck of said bottle, the method comprising the following steps:

a) during closure of said bottle, longitudinally deforming said outside wall of said stopper at least in a portion extending to its base, so as to form at least one vertical channelforming groove in said stopper extending along a longitudinal axis of said bottle, a first end of said channel-forming groove opening out into a portion of said inside wall fraction and a second end of said channel opening out into said outside wall of said stopper by being at a distance of at least 5 mm from the top end of the stopper; and b) continuing the longitudinal deformation throughout the time said bottle is closed by said stopper so that said channel-forming groove persists in said stopper when said bottle is partially opened, so that said second end of said channel opens to the outside of said bottle and puts the inside of the bottle into communication with the outside.

16. A method of deforming a stopper of cork of one of natural, natural and synthetic, and synthetic origin according to claim 15, wherein, during closure of said bottle, said outside wall of said stopper is deformed longitudinally over a portion extending to its base by progressively deforming said wall extending in a contrary direction to said base whereby disengaging said stopper from the neck parallel to said deformation partially releases said rectilinear channel-forming groove from inside wall of said bottle.

17. A method of deforming a stopper of cork of one of natural, natural and synthetic, and synthetic origin according to claim 16, wherein, during closure of said bottle, said outside wall of said stopper is deformed longitudinally over a portion extending to its base, to provide deformation that is in the form of half a cone.

18. A method of deforming a stopper of cork of one of natural, natural and synthetic, and synthetic origin according to claim 17, wherein, during closure of said bottle, said outside wall of said stopper is deformed longitudinally over a portion extending to its base, over a length lying in the range 10 mm to 20 mm.

19. A method of deforming a stopper of cork of one of natural, natural and synthetic, and synthetic origin according to claim 17, wherein, during closure of said bottle, said outside wall of said stopper is deformed longitudinally over a portion extending to its base, over a length lying in the range 10 mm to 20 mm.

20. A method of deforming a stopper of cork of one of natural, natural and synthetic, and synthetic origin according to claim 16, wherein, during closure of said bottle, said outside wall of said stopper is deformed longitudinally over a portion extending to its base, over a length lying in the range 10 mm to 20 mm.

21. A method of deforming a stopper of cork of one of natural, natural and synthetic, and synthetic origin according to claim 15, wherein, during closure of said bottle, said outside wall of said stopper is deformed longitudinally over a portion extending to its base, over a length lying in the range 10 mm to 20 mm.

22. A method of deforming a stopper of cork of one of natural, natural and synthetic, and synthetic origin according to claim 15, wherein, during closure of said bottle, said outside wall of said stopper is deformed longitudinally over a portion extending to its base, by progressively deforming said wall over a portion extending to said base whereby disengaging said stopper from the neck parallel to said deformation partially releases said channel-forming groove.

23. A method of deforming a stopper of cork of one of natural, natural and synthetic, and synthetic origin according to claim 22, wherein, during closure of said bottle, said outside wall of said stopper is deformed longitudinally over a portion extending along said longitudinal axis of said bottle to its base, over a length lying in the range 10 mm to 20 mm.

* * * * *

UNITED STATES PATENT AND TRADEMARK OFFICE

CERTIFICATE OF CORRECTION

PATENT NO. : 7,063,221 B2
APPLICATION NO. : 10/203489
DATED : June 20, 2006
INVENTOR(S) : Enrique Garcie-Cuenca, Jacques Pitoux and Michel Pitoux It is certified that error appears in the above-identified patent and that said Letters Patent is hereby corrected as shown below:

Title Page; (73)
The Assignee Should read:

--AU LIÉGEUR-ETS J. PONTNEAU DENIS--

Signed and Sealed this

Ninth Day of October, 2007

JON W. DUDAS
*Director of the United States Patent and Trademark Office*